US005667298A

United States Patent [19]

Musil et al.

[11] Patent Number: 5,667,298

[45] Date of Patent: Sep. 16, 1997

[54] PORTABLE CONCRETE MIXER WITH WEIGH/SURGE SYSTEMS

[75] Inventors: Joseph E. Musil, Ely; Douglas A. Wilson, Cedar Rapids, both of Iowa

[73] Assignee: Cedarapids, Inc., Cedar Rapids, Iowa

[21] Appl. No.: 587,235

[22] Filed: Jan. 16, 1996

[51] Int. Cl.[6] ..... B28C 5/20; B28C 7/06; B28C 7/12; B28C 7/16

[52] U.S. Cl. ..... 366/18; 366/17; 366/19; 366/33; 366/34; 366/59; 366/68

[58] Field of Search ..... 366/8, 14–19, 366/26–29, 33, 34, 37, 41–43, 53, 54, 56–60, 62, 63, 68, 187, 189, 225, 227, 228, 229, 606; 414/919

[56] References Cited

U.S. PATENT DOCUMENTS

| | | | |
|---|---|---|---|
| 2,278,069 | 3/1942 | Finley | 366/59 X |
| 3,661,365 | 5/1972 | Cloud, Jr. | 366/18 |
| 3,820,762 | 6/1974 | Bostrom et al. | 366/18 |
| 4,044,920 | 8/1977 | Swartzendruber . | |
| 4,189,237 | 2/1980 | Bake | 366/8 X |
| 4,204,773 | 5/1980 | Bates | 366/18 |
| 4,222,498 | 9/1980 | Brock . | |
| 4,281,776 | 8/1981 | Goins . | |
| 4,406,548 | 9/1983 | Haws | 366/8 |
| 4,427,133 | 1/1984 | Kierbow et al. . | |
| 4,538,916 | 9/1985 | Zimmerman | 366/50 X |
| 4,579,459 | 4/1986 | Zimmerman | 366/33 X |
| 4,624,575 | 11/1986 | Lantz | 366/20 X |
| 4,775,275 | 10/1988 | Perry | 366/18 X |
| 4,792,234 | 12/1988 | Doherty | 366/18 X |
| 4,922,463 | 5/1990 | Del Zotto et al. | 366/21 |
| 5,064,099 | 11/1991 | Iwako . | |
| 5,148,943 | 9/1992 | Moller . | |
| 5,240,324 | 8/1993 | Phillips et al. . | |
| 5,407,809 | 4/1995 | Finn | 366/228 X |
| 5,411,329 | 5/1995 | Perry | 366/26 |
| 5,413,154 | 5/1995 | Hurst, Jr. et al. . | |
| 5,474,379 | 12/1995 | Perry | 366/26 |

FOREIGN PATENT DOCUMENTS

| | | | |
|---|---|---|---|
| 2132671 | 1/1973 | Germany . | |
| 2236260 | 4/1991 | United Kingdom | 366/20 |

OTHER PUBLICATIONS

Instruction Manual, "Ramsey Model 60–12 Speed Sensors", Ramsey Engineering Company, St. Paul, Minnesota.

*Primary Examiner*—Charles E. Cooley
*Attorney, Agent, or Firm*—Donald R. Schoonover

[57] ABSTRACT

An improved concrete mixing plant is mounted on several mobile chassis to provide portability. The plant includes a horizontally oriented, internally urethane coated mixing drum having spiral and lift flights such that the rate of discharging concrete material is controllable without altering the direction or rate of rotation. The drum and chute are self-erecting from a low-profile, transport configuration to an elevated, mixing configuration. A water dispensing system wherein the water is automatically measured volumetrically or, alternatively, gravimetrically provides automatic cleaning of internal surfaces of the mixing drum as an integral part of the batching process. Feeder belt and weighbridge arrangements are interposed between bins containing denser ingredients and a collecting conveyor to provide a first surge capability. A hopper and load cell arrangement is interposed between a compartmented silo and a surge conveyor to provide a further surge capability. A ploughing arrangement places lighter ingredients within a furrow in the denser ingredients to minimize generation of airborne particulate matter within the surge conveyor. A baghouse filter and blower arrangement creates a negative pressure relative to ambient atmosphere within a containment system for eliminating contamination from airborne particulate matter. A control unit interconnecting the various components substantially automates the plant.

20 Claims, 6 Drawing Sheets

PORTABLE CONCRETE MIXER WITH WEIGH/SURGE SYSTEMS

BACKGROUND OF THE INVENTION

1. Field of the Invention

The present invention relates generally to a concrete mixing plant and components thereof, and, particularly, without limitation, to such a plant that is portable for jobsite use.

2. Description of the Related Art

Pourable wet concrete material is readily available from numerous concrete plants that place various ingredients for mixing concrete material into a special purpose truck that mixes the ingredients into the concrete material as the truck is driven to the jobsite where the concrete material is needed. The concrete material must be finally placed within a matter of minutes after water is added to the ingredients and the mixing process is initiated, e.g., twenty minutes. Thus, the construction project must be situated within a twenty-minute drive of the concrete plant that places the ingredients into the trucks. Otherwise, the design strength characteristics of the concrete material, after hardening, may have been compromised. Projects which are located beyond the allowable haul time generally must seek a suitable concrete plant that can be erected at jobsite, thereby eliminating much of the transportation costs as the ingredients can then be hauled to jobsite in bulk.

One of the problems with erecting a concrete mixing plant at jobsite is the expense involved; only projects requiring substantial quantities of concrete can justify such an arrangement. Further, the various components of such plants are large and bulky, and generally require erection cranes for erecting those components, which adds to the overall concrete expense. Of course, the erection cranes must return to the jobsite when the components are being dismantled before being moved to another site.

Another problem with available portable jobsite concrete mixing plants is the procedure which must be followed in order to reduce airborne particulate contamination to acceptable levels. For example, cement and fly ash ingredients used for making concrete material consists of very fine particles. As a result, such particles easily become airborne, contaminating the surrounding atmosphere and surfaces.

Other problems with available concrete mixing equipment include undesirable accumulation of hardened concrete on mixing surfaces, segregation of ingredients due to dumping ingredients together instead of blending them together, and less than maximum space utilization due to inability to operate a mixer about a horizontal axis.

Although mixer trucks designed to haul the concrete material are available in various sizes, the maximum size permissible is limited by several considerations, such as physical size, maximum highway and bridge load limits, etc. As a result, substantial transportation costs must be absorbed in the price of the concrete. Further, numerous trucks must be closely coordinated to provide the substantial quantities of concrete material sometimes needed for larger construction projects.

During the early part of this century, concrete mixers were generally horizontally oriented as such a configuration permitted more efficient utilization of available space with width and height requirements remaining within acceptable limits. Unfortunately, such horizontally oriented mixers were difficult to keep clean and experienced substantial and unacceptable build-up of concrete material on the mixing surfaces. As a result, concrete mixer design trended toward a configuration where mixing occurred horizontally but the axis was tilted to effect discharge.

What is needed is a portable concrete mixing plant that eliminates contamination caused by generation of airborne particulate matter by minimizing those activities which are most conducive to such generation; a portable concrete mixing plant using weigh surge techniques whereby cycle time for mixing a batch of concrete material is substantially reduced; a portable concrete plant that can be easily and quickly moved to a jobsite and erected and dismantled without the use of erecting cranes; a portable concrete plant that utilizes a water dispensing system whereby water for mixing concrete material can be quickly transferred to a mixer while simultaneously cleaning interior surfaces of the mixer as an integral part of the mixing process; a concrete plant that does not dump ingredients together but, instead, blends the ingredients together; a concrete plant that gravimetrically measures ingredients for concrete material; and a mixer having a horizontal axis that can be efficiently operated without material building up on internal surfaces thereof.

SUMMARY OF THE INVENTION

An improved portable concrete mixing plant is provided that uses weigh surge and water dispensing apparatus for reducing cycle time and for automatically cleaning mixing surfaces as an integral part of the batch mixing process, that reduces or entirely eliminates contamination from airborne particulate matter, that blends ingredients for mixing concrete material instead of dumping the ingredients together, and that eliminates the need for cranes when erecting or dismantling a portable concrete plant.

The portable concrete mixing plant includes a mixer that is self-erecting from a transport configuration to a mixing configuration, involving hoisting a discharge chute assembly and a mixing drum from a low-profile position to an elevated position wherein trucks can receive the concrete material from a discharge chute of the discharge chute assembly. Ingredients for mixing concrete material are introduced into an input end and discharged from a discharge end. Water and other liquid additives are volumetrically or gravimetrically measured and injected under pressure into the mixing drum in a manner that sprays and cleans any residual concrete material and ingredients from urethane coated interior surfaces of the mixing drum as an integral part of the mixing process.

Spiral flights in the mixing drum mix the ingredients to form the pourable concrete material as the ingredients are urged toward the discharge end of the mixing drum. Alter the concrete material is mixed, a concrete discharge chute is displaced axially inwardly into the mixing drum whereby lift flights, without reversing the direction of rotation of the mixing drum, lift the concrete material and deposit it into the discharge chute. The rate that the concrete material is discharged from the mixing drum is controlled by the extent that the discharge chute is displaced inwardly into the mixing drum. Alter the final batch of concrete has been discharged, a water dispensing system once again cleans the coated interior surfaces of the mixing drum and the lift flights convey the free flowing water into the discharge chute.

A first conveyor apparatus includes a feeder belt conveyor and a weigh bridge mechanism under each of a plurality of bins, each containing an ingredient for the concrete material and each controlled whereby a desired amount of the respective ingredient is transferred to an underlying conveyor belt in a surge arrangement that provides the desired proportions for a corresponding batch of concrete material.

A second conveyor apparatus, also having a surge arrangement, conveys the ingredients from the first conveyor apparatus to the mixing drum. Superimposed over the second conveyor is a silo having compartments containing powdered cement and fly ash ingredients.

The powdered cement and fly ash ingredients are sequentially gravimetrically measured into an underlying hopper and are released at a low elevation relative to a conveyor belt of the second conveyor apparatus in order to minimize creation of airborne particulate matter upon impact. The powdered cement and fly ash ingredients are also deposited in a furrow ploughed into heavier ingredients being conveyed from the first conveyor apparatus toward the mixing drum whereby the heavier ingredients fold over the powdered cement and fly ash ingredients to further minimize creation of airborne particulate matter.

An enclosure about the second conveyor apparatus and the silo are both ducted to a baghouse filter such that a negative pressure, relative to the ambient atmosphere, is developed in substantially all areas of the plant wherein contaminating airborne particulate matter may be generated during the mixing process.

PRINCIPAL OBJECTS AND ADVANTAGES OF THE INVENTION

The principal objects and advantages of the present invention include: providing an apparatus for mixing concrete material whereby contamination by airborne particulate matter is minimized or entirely eliminated; providing such an apparatus whereby the cycle time for mixing subsequent batches of concrete material is substantially reduced; providing such an apparatus that can be erected and dismantled without the use of erecting cranes; providing such an apparatus that utilizes a water dispensing system whereby water for mixing concrete material can be quickly transferred to a mixer while simultaneously cleaning interior surfaces of the mixer; providing such an apparatus having a horizontal axis that can be efficiently operated without material building up on internal surfaces thereof; providing such an apparatus using weigh surge techniques to reduce cycle time; providing such an apparatus that "blends" ingredients together for mixing concrete material; and generally providing such an apparatus and method that are reliable in performance, and are particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

Figure 1:
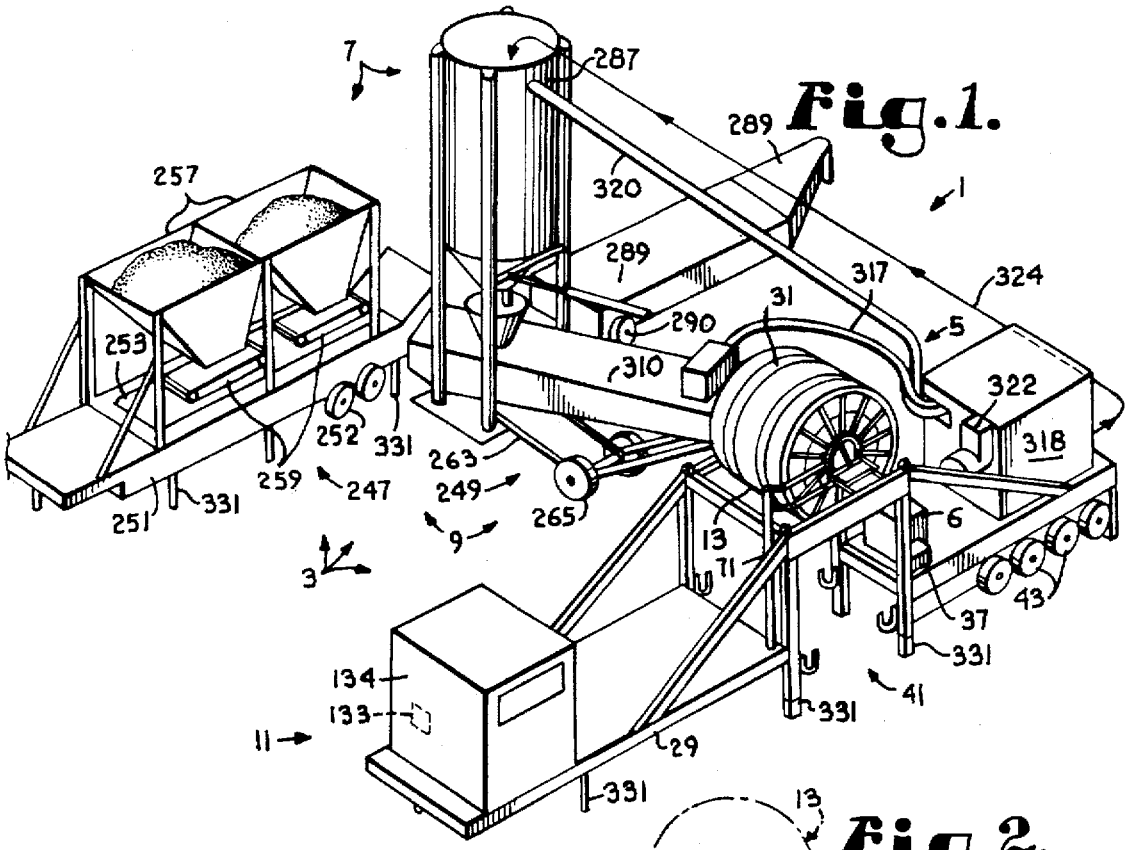
FIG. 1 is an isometric and fragmentary drawing of a portable concrete mixing plant with weigh feeder bins, cement and fly ash storage silo, surge conveyor and unified mixing chassis but shown without a discharge chute mechanism for purposes of clarity, according to the present invention.
Figure 2:
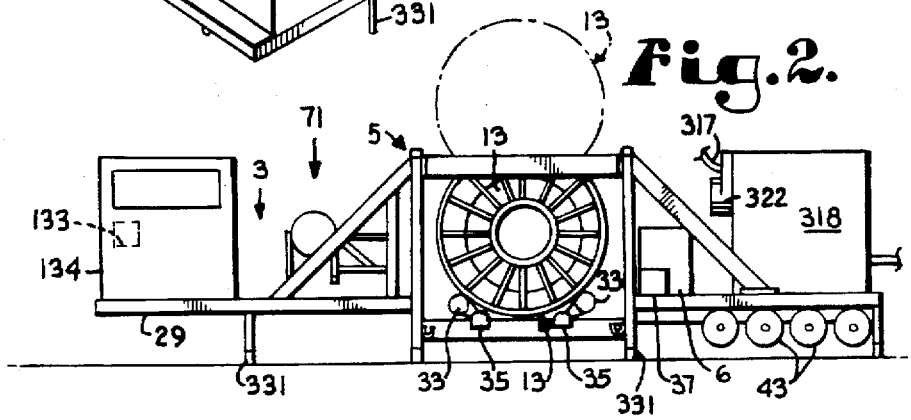
FIG. 2 is a schematic and fragmentary side elevational view of the portable concrete mixing plant, showing a mixer chassis with a mixing drum in a transport configuration in solid lines and outlined in broken lines in a mixing configuration, a control house, a baghouse, a water system, a discharge chute and deployment system.
Figure 3:
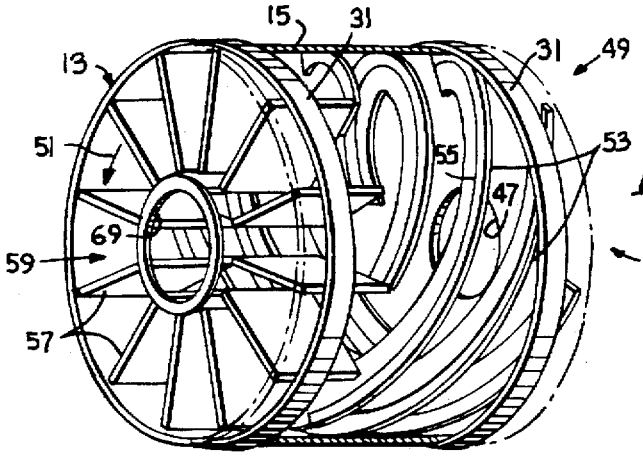
FIG. 3 is an enlarged isometric, fragmentary and schematic representation of the mixing drum of the portable concrete mixing plant, showing "tires", spiral flights, lift flights, chute void, discharge port and input port thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a portable concrete mixing plant with weigh/surge systems according to the present invention, as shown in FIGS. 1 through 16. The plant 1 generally includes frame means 3, mixing means 5 including liquid dispensing means 6 for mixing various ingredients into pourable wet concrete material 8, containing means 7 for containing various dry ingredients for mixing the concrete material 8, conveying means 9 for conveying the various dry ingredients from the containing means 7 to the mixing means 5 in desired proportions for mixing the pourable concrete material 8, and control means 11 for automatically controlling the various components of the plant 1 during operation thereof.

The mixing means 5, which is self-erecting as hereinafter described, includes a mixing drum 13 having a cylindrically shaped peripheral wall 15 with inner and outer peripheral surfaces 17 and 19 respectively, an input end 21, a discharge end 23, and a longitudinal axis as designated by the numeral 25 in FIG. 6. Preferably, the longitudinal axis 25 is substantially horizontally oriented. However, it is to be understood that the longitudinal axis 25 may be inclined for some applications.

Figure 16:
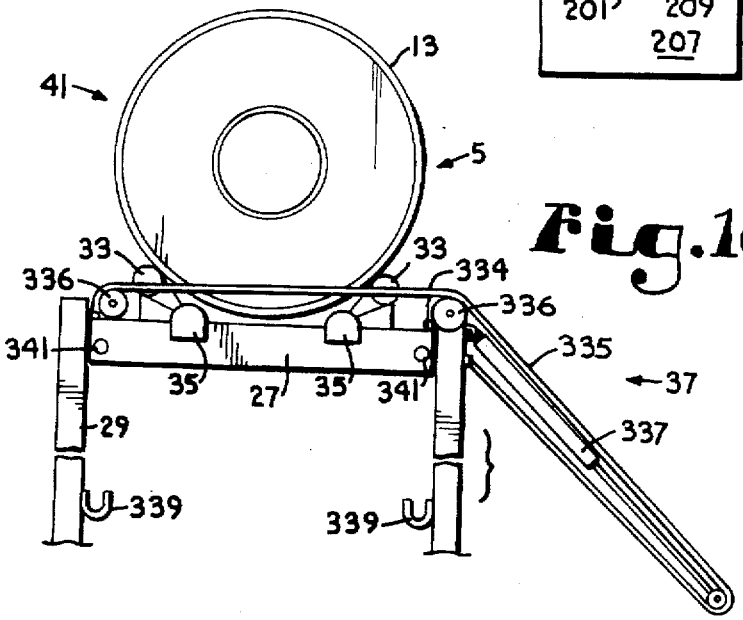
FIG. 16 is an enlarged side elevational and schematic view similar to that shown in FIG. 15 but showing the erecting mechanism in the mixing configuration, according to the present invention.

The frame means 3 includes a mixer frame 27 adapted to support the mixing drum 13 on a mixer chassis 29. The mixing drum 13 is mounted on the mixer frame 27 by means of a pair of peripheral rings or "tires" 31 connected to the outer surface 19 of the wall 15. The rings 31 are supported by trunnions 33 whereby the mixing drum 13 is axially rotatable about the longitudinal axis 25 by one or more motors 35, as schematically indicated in FIG. 16. The mixer chassis 29 includes a mixer hydraulic system 37 for positioning the mixer frame 27 relative to the mixer chassis 29. The mixer hydraulic system 37 is adapted to lower the mixer frame 27 relative to the mixer chassis 29 to a transport configuration, as indicated by the numeral 39 in FIGS. 5 and 15, and to elevate the mixer frame 27 relative to the mixer chassis 29 to a mixing configuration, as indicated by the numeral 41 in FIGS. 4 and 16 and as hereinafter described in greater detail. The mixer chassis 29 generally includes one or more wheel and axle assemblies 43 to provide portability for the mixer chassis 29.

Figure 10:
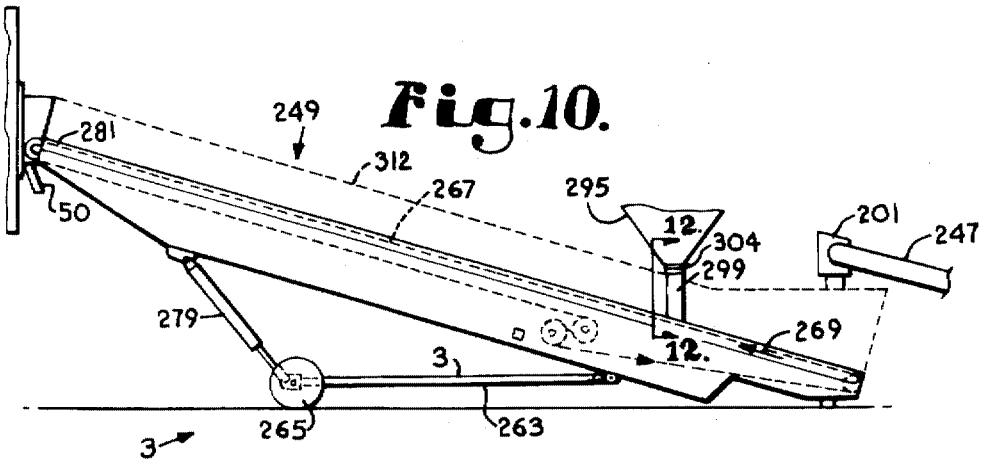
FIG. 10 is a side elevational and fragmentary view of a chassis of the surge conveyor apparatus of the portable concrete mixing plant, shown slightly reduced from that shown in FIG. 9.

The mixing means 5 includes an input chute 45, situated at the input end 21 of the mixing drum 13, for receiving the various ingredients delivered to the mixing drum 13 for mixing the concrete material 8. The input chute 45 is configured to operatively feed the various ingredients for mixing the concrete material 8 through an input port 47 into a mixing cavity 49 in the interior of the mixing drum 13. A bypass or calibration chute 50 may be provided to bypass the mixing means 5, as schematically indicated in FIGS. 6 and 10, in the event that the mixing means 5 malfunctions or is not needed.

For example, the dry ingredients in the proper proportions, as hereinafter described, could be conveyed through the bypass chute 50 and deposited in commonly known concrete mixer trucks where water is added to complete production of the concrete material while being transported by the concrete mixer trucks. In that event, the input chute 45 would be arranged to direct the ingredients through the bypass chute 50 and to block the ingredients from the path they would otherwise take if they were to be conveyed into the mixing drum 13. To dispense dry ingredients with the present invention is particularly advantageous due to the blending of the various ingredients as they are transferred and conveyed from and by the various conveyor systems and herein described.

The bypass or calibration chute 50 may similarly be used to draw a dry sample of the ingredients, just prior to the ingredients being placed in the mixing dram 13, to analyze the accuracy of the combined portions of the ingredients. In that event, a dump truck (not shown) could be backed beneath the mixing drum 13, as suggested by the arrow labeled by the numeral 52 in FIG. 1, to receive such a sample for analysis. Of course, the input chute 45 would be blocked whereby the sample is dropped into the underlying truck instead of into the mixing drum 13.

As the various ingredients are received in the mixing cavity 49, the mixing drum 13 is rotated about the longitudinal axis 25, as indicated by the numeral 51, whereby the various ingredients are tumbled, mixed, and urged toward the discharge end 23 of the mixing drum 13 by one or more spiral flights 53 with fins 55, spaced within the mixing cavity 49 and secured to the inner surface 17 of the peripheral wall 15 of the mixing drum 13. The spiral flights 53 span a substantial portion of the axial distance from the input end 21 of the mixing drum 13 toward the discharge end 23 of the mixing drum 13.

The remainder of the axial distance from the spiral flights 53 to the discharge end 23 of the mixing drum 13 is spanned by a plurality of lift flights 57 that extend generally axially inwardly into the mixing cavity 49 from the discharge end 23 and generally radially inwardly into the mixing cavity 49 from the peripheral wall 15. The lift flights 57 are configured to substantially remove all free flowing liquid from within the mixing cavity 49 simply by rotating the mixing drum 13 as hereinafter described. If desired, the lift flights 57 may have flared edges to enhance their ability to remove such free flowing liquid from the mixing cavity 49.

Figure 4:
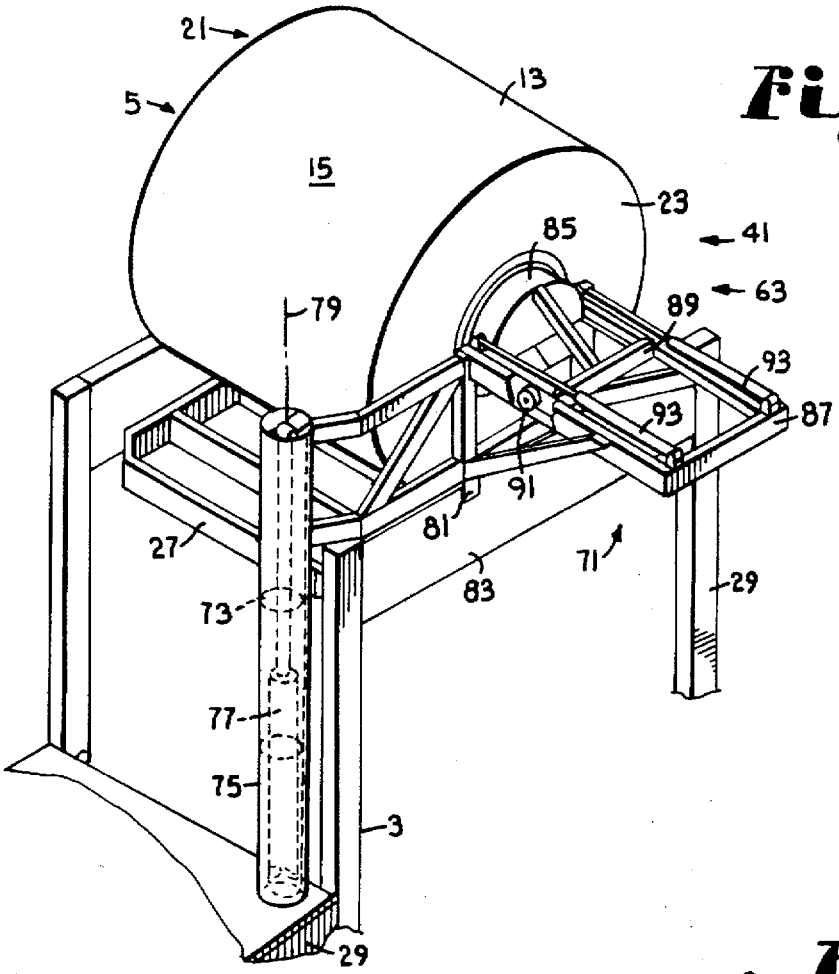
FIG. 4 is an enlarged isometric and fragmentary view of the portable concrete mixing plant, showing the mixing drum in an erected mixing configuration and a discharge chute mechanism in a discharge configuration with a portion cut away to reveal a cam follower thereof.

A chute void 59 exits centrally within the lift flights 57 to receive a discharge chute 61 as the mixing drum 13 assumes a discharge configuration, as hereinafter described and as indicated by numeral 63 in FIG. 4 and as indicated schematically by dotted lines in FIG. 6. All surfaces 65 of the mixing cavity 49 are substantially entirely covered with a coating 67 to minimize or prevent tendency of the concrete material 8 from adhering to the surfaces 65. For example, all of the surfaces 65 may be coated with an ultra-high-molecular-weight material, such as a coating of urethane having a thickness of approximately one inch.

Figure 5:
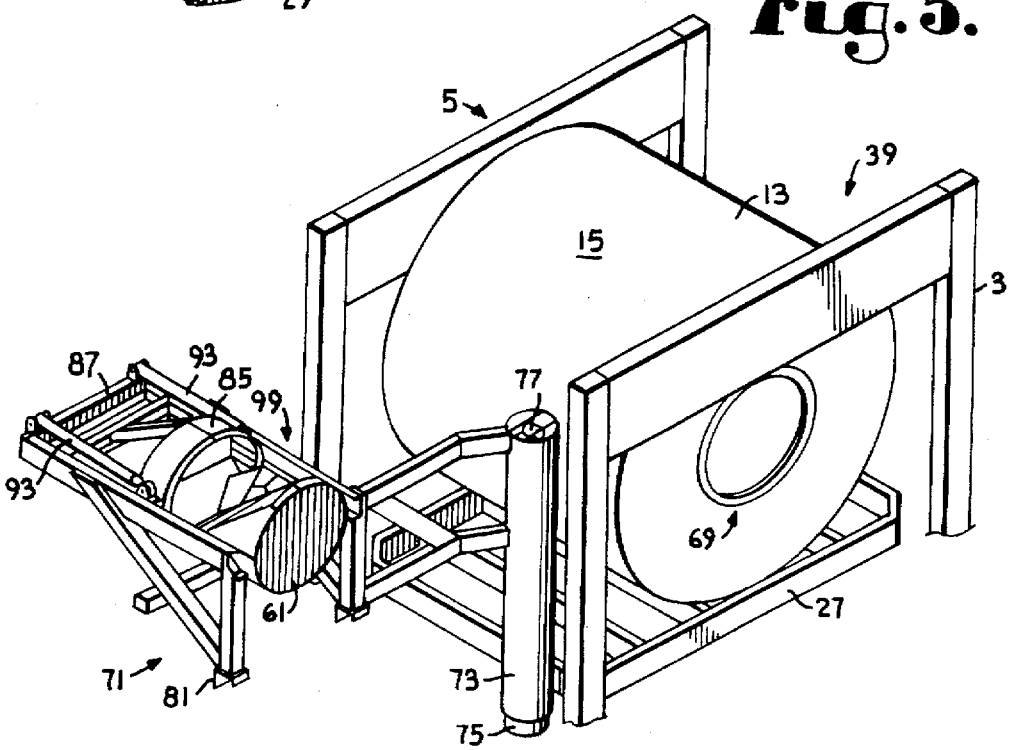
FIG. 5 is an enlarged isometric and fragmentary view of the portable concrete mixing plant similar to that shown in FIG. 4 but showing the mixing drum and the discharge chute mechanism in a transport configuration.

The mixing drum 13 includes an exit port 69 spaced centrally at the discharge end 23 of the mixing drum 13, as shown in FIG. 5. The discharge chute 61 is mounted in a discharge chute assembly 71 which, in turn, is pivotally mounted on the mixer chassis 29, such as by a pair of telescoping cylindrical mounting members 73 and 75, as indicated in FIG. 4. As the mixer chassis 29 is in the transport configuration 39, the mounting members 73 and 75 are telescoped such that the discharge chute mechanism 71 is substantially stored in a low-profile arrangement alongside the mixing drum 13, as shown in FIG. 5. During conversion of the mixing means 5 to the mixing configuration 41, the outer mounting member 73 is elevated relative to the inner mounting member 75 by a hydraulic cylinder arrangement 77 such that the discharge chute 61 is rotatable approximately 180° about a generally vertical axis 79 and lowered whereby a C-shaped bracket 81 is disposed about and stabilized by a side member 83 of the mixer chassis 29 and a collar 85 of the discharge chute assembly 71 is disposed adjacent to and aligned with the exit port 69, as shown in FIG. 4.

The discharge chute assembly 71 includes an outer platform 87 constructed of C-shaped structural channel material and extending generally axially outwardly from the collar 85. The discharge chute assembly 71 also includes an inner platform 89 secured to the discharge chute 61 and aligned with the outer platform 87 by a plurality of cam followers 91. The inner platform 89 is connected to the outer platform 87 by one or more hydraulic cylinders 93 such that the concrete chute 61 can be displaced, as indicated by the arrow designated by the numeral 95 in FIG. 6, between the discharge configuration 63 and a non-discharge configuration, as schematically indicated by the solid lines designated by the numeral 97 in FIG. 6. In addition, stroke length of the cylinders 93 is preferably sufficient, not only to displace the discharge chute 61 between the discharge and the non-discharge configurations 63 and 97 but also, for removal of the discharge chute 61 from the inner platform 89. For example, the cylinders 93 may have a minimum stroke length of approximately forty-eight inches for some applications.

As the discharge chute 61 assumes the discharge configuration 63, the portion of the discharge chute 61 extending into the mixing cavity 49 is substantially co-extensive with the chute void 59 and has an upwardly directed opening 99 for gravitationally receiving the concrete material 8 and free flowing liquid from the lift flights 57 as the mixing drum 13 is rotated about the longitudinal axis 25. As the discharge chute 61 is displaced outwardly by the hydraulic cylinders 93 to assume the non-discharge configuration 97, an inner plate 101 thereof is configured and dimensioned to close the exit port 69 in order to prevent the concrete material 8 that is being urged toward the discharge end 23 by the spiral flights 53 from escaping from the mixing cavity 49.

The rate that the concrete material 8 is discharged from the mixing drum 13 is controlled by the extent that the discharge chute 61 extends into the chute void 59. If it is desired to decrease the rate that the concrete material 8 is discharged from the mixing drum 13, then the discharge chute 61 is displaced axially outwardly from the mixing drum 13. Similarly, if the upwardly directed opening 99 of the discharge chute 61 exposed within the mixing drum 13 can be increased by displacing the discharge chute 61 axially inwardly into the chute void 59, then the rate that the concrete material 8 can be discharged from the mixing drum 13 can be increased accordingly.

The operational characteristics of the discharge chute 61 are similar to those of the discharge chute taught in U.S. Pat. No. 5,380,085 entitled "A concrete Mixer With Reciprocating Discharge Chute", issued Jan. 10, 1995 to Robert C. Milek, which patent is incorporated herein by reference.

It is to be understood that all structural components of the plant 1, as previously and hereinafter described, are constructed of materials having sufficient strength to withstand the substantial forces and moments involved with the various components of the plant 1. For example, the mounting members 73 and 75 may be constructed of 18-inch and 16-inch tubular steel members having wall thickness of one-half inch, respectively, and the components of the discharge chute assembly 71 connecting the outer platform 87 to the outer mounting member 73 may be constructed of 4×4, 6×6, and 8×4 structural tubing members having wall thickness of three-eighths inch, or other dimensions and configurations as appropriate.

Figure 6:
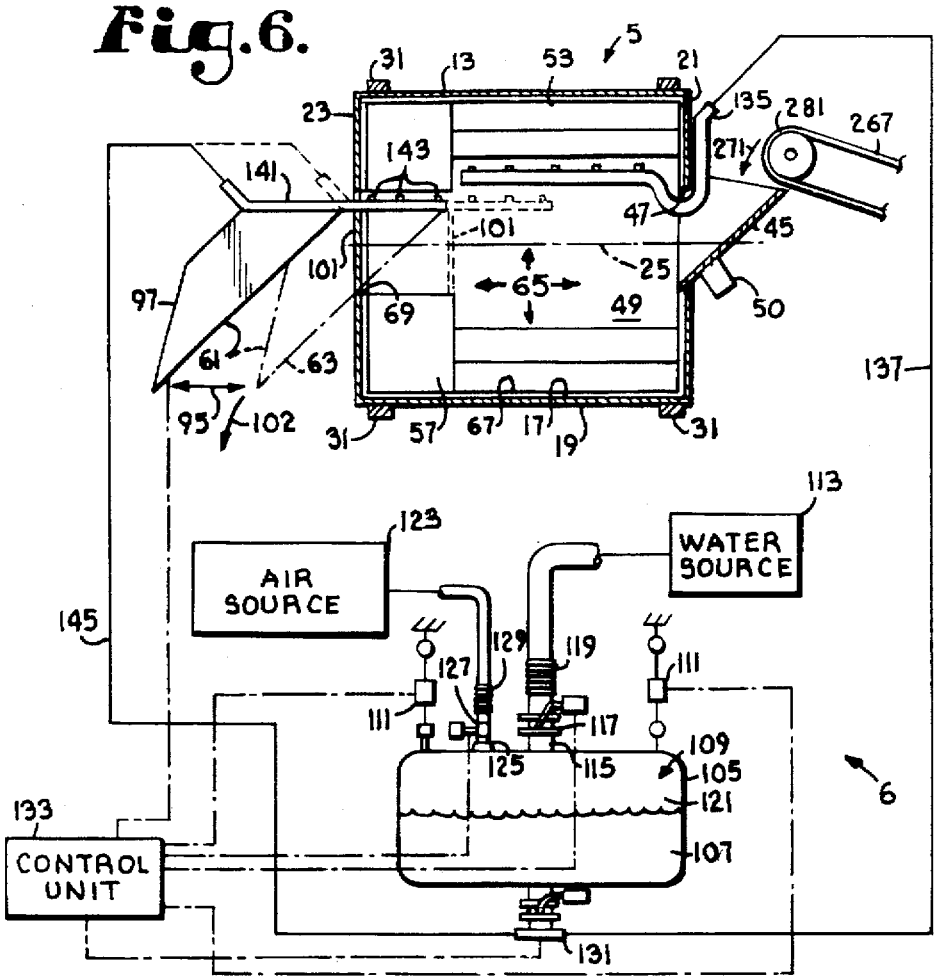
FIG. 6 is a schematic and fragmentary representation of the portable concrete mixing plant, showing a gravimetric water measuring and delivery system thereof.

The height of the mixing drum 13 above ground elevation as the mixing drum 13 is in the mixing configuration 41 is sufficient whereby trucks (not shown) hauling the concrete material 8 from the mixing drum 13 for further distribution can drive alongside the mixer chassis 29 and under lower extremities of the discharge chute 61 for gravitational loading of the concrete material 8 into the trucks, as indicated by the arrow designated by the numeral 102 in FIG. 6.

The liquid dispersing means 6 generally includes a tank 105 having sufficient capacity to hold enough primary water or water 107 for mixing a batch, for example twelve cubic yards, of the concrete material 8 in the mixing means 5. Generally, however, the quantity of the water 107 contained in the tank 105 is less than the amount needed to provide the concrete material 8 with the desired slump characteristic; the balance, or "temper" water, needed to provide the desired slump characteristic is added after the ingredients are mixed with the water 107 provided from the tank 105.

The slump can be remotely determined by monitoring the amperage drawn by the motors 35. If the mixed concrete material 8 does not have enough slump or, in other words, is too dry, then the amperage drawn by the motors 35 will be higher than it would be if the slump is satisfactory or too large, which would indicate that the concrete material 8 is too wet. Thus, after the ingredients in the mixing drum 13 have been mixed with the water 107 from the tank 105, the "temper" or make-up water is added to the concrete material 8 being mixed in the mixing drum 13 to reduce the amperage drawn by the motors 35 to the magnitude of amperage that indicates that the concrete material 8 in the mixing drum 13 has the desired slump.

Preferably, the tank 105 also has sufficient airspace 109 above the water 107 whereby the water 107 can be appropriately pressurized for rapid discharge of the water 107 from the tank 105 into the mixing cavity 49 and for cleaning the surfaces 65, as hereinafter described.

The tank 105 is suspended from, or supported on, one or more load cells 111 for monitoring and controlling, such as by gravimetrically measuring, the quantity of the water 107 contained in the tank 105. The water 107 is introduced into the tank 105 from a water source 113 through an inlet port 115 and control valve 117. Preferably, the water source 113 is connected through a flexible connector 119 in order to minimize influence of the water source 113 and the intervening connections on the desired monitoring and controlling accuracies otherwise providable by the load cells 111.

Similarly, pressurized air 121 is introduced into the tank 105 from an air source 123, such as a compressor, through an inlet port 125, control valve 127, and flexible connector 129. The tank 105 also includes a supply valve 131 for supplying the water 107 to the mixing cavity 49, as hereinafter described. The pressurization and sizing of the various components are configured to operatively transfer the water 107 and the various ingredients, as hereinafter described, into the mixing drum 13 whereby a new batch of the concrete material 8, such as the exemplary twelve-cubic-yard batch, can be mixed approximately every ninety seconds.

The load cells 111, the control valve 117, the control valve 127, and the supply valve 131 are communicatively coupled to the control means 11, such as a control unit 133 housed in a control room 134, for monitoring and controlling purposes. Similarly, the hydraulic cylinders 93 are communicatively coupled to the control unit 133 for monitoring and controlling the discharge and non-discharge configurations 63 and 97, and any position intermediate to those configurations, of the discharge chute 71. If desired, a drain plug (not shown) may be provided for draining the water 107 from the tank 105.

The liquid dispersing means 6 includes a primary liquid dispersing bar 135 mounted through the input port 47 and configured to extend axially into the mixing cavity 49, as shown in FIG. 6. The primary liquid dispersing bar 135 is mounted whereby it remains fixed as the mixing drum 13 rotates about the longitudinal axis 25. The water 107 is delivered from the tank 105 to the primary liquid dispersing bar 135 through piping 137. The primary liquid dispersing bar 135 has a plurality of ports 139 that are configured to operably spray the water 107, under pressure, in a plurality of directions but generally upwardly against the spiral flights 53 and the other surfaces 65 as they revolve above the ports 139. The primary liquid dispersing bar 135 not only cleans the surfaces 65 by dislodging any of the concrete material 8 and ingredients thereof that may have temporarily adhered to the surfaces 65 but also provides all of the water 107, except for the temper water as hereinbefore described, for the next batch of the concrete material 8 to be mixed in the mixing cavity 49.

A secondary liquid dispersing bar 141, having a plurality of ports 143 and connected to the tank 105 through piping 145, is similarly mounted through the exit port 69 and the cavity void 59. The secondary liquid dispersing bar 141 is configured to primarily clean the lift flights 57 and portions of the surfaces 65 adjacent thereto as the discharge chute 61 is disposed in the non-discharge configuration 97. The liquid dispersing bars 135 and 141 provide means for cleaning the mixing drum 13 during the initial phase of mixing each new batch of the concrete material 8, thereby including a cleaning procedure as an integral part of the batching process. For some applications, it may be preferable to eliminate the secondary liquid dispersing bar 141 and modify the primary liquid dispersing bar 135 whereby all of the surfaces 65 are cleaned by the primary liquid dispersing bar 135.

It is to be understood that liquid additives may be introduced into the mixing cavity 49 through the liquid dispersing means 6, if desired. In that event, such liquid additives, introduced sequentially with the water 107, would be introduced into the tank 105 through appropriate input means, similar to the inlet port 115, the control valve 107 and the flexible connector 119, as hereinbefore described, and similarly monitored by the control unit 133.

Figure 7:
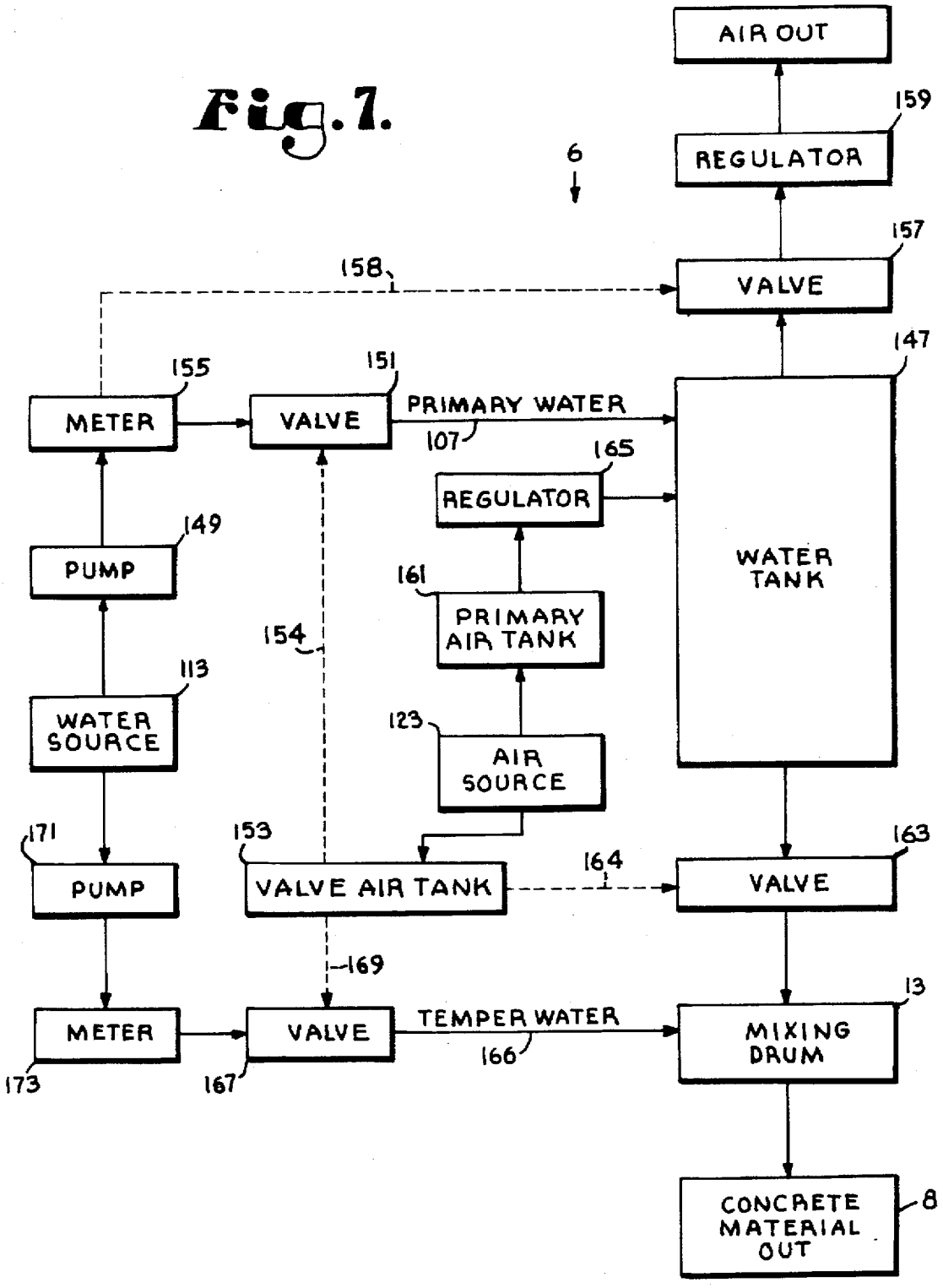
FIG. 7 is a schematic representation of an alternate embodiment of a volumetric water metering and delivery system of the portable concrete mixing plant.

An alternative embodiment of the liquid dispensing means 6 is shown in FIG. 7. Primary water 107 from the water source 113 is introduced into a water tank 147 by a pump 149 upon opening of a valve 151 operated by pressurized air from a valve air tank 153, as indicated by a broken line designated by the numeral 154 in FIG. 7. A meter 155 is used to volumetrically monitor and control the quantity of the water 107 being placed in the tank 147; for example, the tank 147 may have sufficient capacity to hold 500 gallons of the water 107. If desired, check valves (not shown) may be installed in the various air and water lines to prevent undesired backflow by methods commonly known by those with ordinary skill in the art.

Also, as the meter 155 meters the water 107 flowing into the tank 147, the meter 155 causes a valve 157 in flow communication with the tank 147 to open, as indicated by a broken line designated by the numeral 158 in FIG. 7. The valve 157 is also capable of flow communication with the ambient atmosphere when permitted by a regulator 159. As the water 107 displaces the air in the tank 147, the pressure within the tank 147 increases. When that pressure reaches the setting of the regulator 159, air from the tank 147 escapes into the atmosphere, thereby maintaining the pressure within the tank 147 at or below a pre-selected maximum pressure such as, for example, thirty pounds per square inch.

Air for the valve air tank 153 is provided by the air source 123, which also provides air for a primary air tank 161 that is used to force the water 107 from the tank 147 into the mixing drum 13, as described herein. For example, the air tank 161 may have a capacity of approximately 240 gallons.

Upon signal from the control unit 133, a valve 163 is opened by pressurized air from the valve air tank 153, as indicated by a broken line designated by the numeral 164 in FIG. 7, and air from the air tank 161 is directed into the water tank 147 at a pressure determined by a regulator 165. As the meter 155 is not operating as the water 107 is being transferred from the tank 147 to the mixing drum 13, the valve 157 is closed, thereby preventing air being used to transfer the water 107 from the tank 147 to the mixing drum 13 from being exhausted into the atmosphere.

As previously described, the quantity of the water 107 contained in the tank 147 is less than the quantity actually needed to mix the ingredients in the mixing drum 13 into the concrete material 8 having the desired slump. After the mixing means 5 has thoroughly mixed the water supplied from the tank 147 with the ingredients in the mixing drum 13, the amperage drawn by the motors 35 is monitored and temper water, as indicated by the arrow designated by the numeral 166 in FIG. 7, is added, either manually or automatically, accordingly. The temper water 166 is added by opening a valve 167 with air from the valve air tank 153, as indicated by the broken line designated by the number 169, whereupon a pump 171 pumps the temper water 165 through a meter 173, for volumetric measuring purposes, and into the mixing drum 13.

It is also to be understood that use of the liquid dispersing means 6 is not restricted to the improved concrete mixing plant 1 taught herein, but, instead, is readily adaptable as a subsystem to many existing portable and fixed-base applications of a similar nature.

Preferably, the conveying means 9 includes one or more weigh/surge systems, such as a collecting conveyor apparatus 247 and a surge conveyor apparatus 249. It is to be understood, however, that the collecting conveyor apparatus 247 may be eliminated or combined with the surge conveyor apparatus 249 for some applications.

The portion of the frame means 3 for the collecting conveyor apparatus 247 includes a collecting conveyor chassis 251 mounted on one or more wheel and axle assemblies 252. The collecting conveyor apparatus 247 includes a belt conveyor 253 having a trough-like arrangement, similar to that as hereinafter described in relation to the surge conveyor apparatus 249, that is driven such that an upper surface 255 thereof is driven toward the surge conveyor apparatus 249, as indicated by the arrow designated by the numeral 257 in FIG. 8, whereby materials being conveyed by the belt conveyor 253 are gravitationally unloaded onto the surge conveyor apparatus 249. The belt conveyor 253 is appropriately communicatively coupled to the control unit 133 such that starting and stopping of the belt conveyor 253 may be monitored and controlled by the control unit 133.

Figure 8:
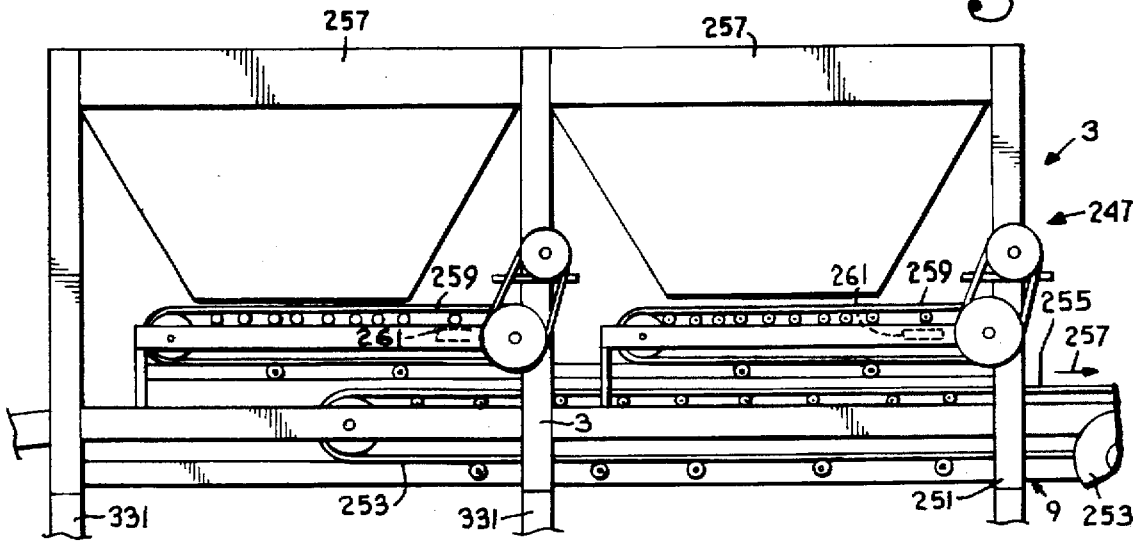
FIG. 8 is a schematic and fragmentary side elevational view of a collecting conveyor apparatus of the portable concrete mixing plant, showing a weigh/surge system thereof.

The portion of the containing means 7 for the collecting conveyor apparatus 247 includes one or more bins 257 arranged in side-by-side relation and superimposed over the belt conveyor 253, as indicated in FIG. 8. Each of the bins 257 contains, in bulk, one of the ingredients to be used for the concrete material 8 to be mixed in the mixing drum 13, such as gravel or sand, etc. Interposed between each of the bins 257 and the belt conveyor 253 is a separate feeder belt conveyor 259, as schematically shown in FIG. 8. Associated with each of the feeder belt conveyors 259 is a separate weigh-bridge mechanism 261, such as a Model 60-12 Speed Sensor in conjunction with an integrator/totalizer as provided by Ramsey Engineering Company of St. Paul Minn., that is communicatively coupled to the control unit 133 for individually monitoring and gravimetrically controlling the quantity of the respective ingredient dispensed from the respective overlying bin 257 for the respective batch of the concrete material 8.

As an ingredient is being measured by weight for inclusion in the next batch of the concrete material 8 to be mixed, the respective feeder belt conveyor 259 continues to be driven whereby that ingredient is gravitationally transferred to the underlying belt conveyor 253. As the respective weigh-bridge mechanism 261 signals the control unit 133 that the appropriate amount of the respective ingredient has been transferred to the belt conveyor 253, the control unit 133 stops the respective feeder belt conveyor 259 until demand is signaled by the control unit 133 for the next following batch of the concrete material 8. A similar procedure is provided for each of the bins 257 that provide an ingredient for the respective batch of the concrete material 8, as monitored and controlled by the control unit 133. Generally, the belt conveyor 253 will be operating at all times that any of the feeder belt conveyors 259 are operating in order to prevent one or more of the ingredients being supplied by the feeder belt conveyors 259 from piling up on the belt conveyor 253.

It is to be understood that, for some applications, the quantity of an ingredient being transferred to the belt conveyor 253 may be controlled by a valve (not shown) in the respective bin 257 and the associated feeder belt conveyor 259 allowed to operate continuously; for other applications, the quantity of an ingredient being transferred to the belt conveyor 253 may be controlled by starting and stopping the respective feeder belt conveyor 259. It is also foreseen that some applications may use one of such controlling methods for one or more of the ingredients and the other of such controlling methods for other ones of the ingredients.

As pure sand tends to adhere to the belt conveyor 253, another ingredient such as gravel is preferably first deposited onto the belt conveyor 253 in order to reduce contact between sand and the belt conveyor 253. For example, the bin 257 farthest from the surge conveyor apparatus 249 could contain gravel. Provided that gravel was appropriately deposited on the belt conveyor 253 before sand was subsequently deposited thereon, a layer of gravel would separate the sand from the belt conveyor 253.

Figure 13:
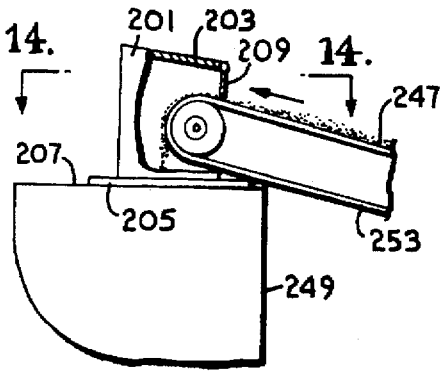
FIG. 13 is an enlarged and fragmentary, partially cross-sectional, side elevational view of a swivel mechanism connecting the collecting conveyor apparatus to the surge conveyor apparatus of the portable concrete mixing plant.
Figure 14:
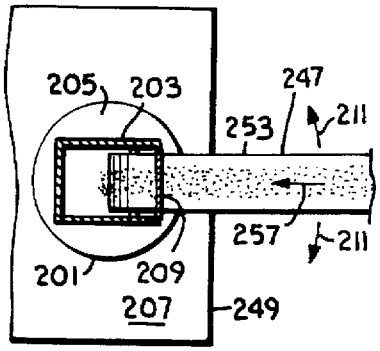
FIG. 14 is an enlarged and fragmentary, partially cross-sectional, plan view of the swivel mechanism of the portable concrete mixing plant, taken along line 14—14 of FIG. 13.

After all of the ingredients provided by the bins 257 for a selected batch of the concrete material 8 have been transferred to the belt conveyor 253 as determined by the control unit 133, the belt conveyor 253 is stopped by the control unit 133 until further signaled by the control unit 133 to re-start, whereupon those ingredients are transferred to the surge conveyor apparatus 249. The collecting conveyor apparatus 247 includes an adapter 201 for connecting the collecting conveyor apparatus 247 to the surge conveyor apparatus 249, as schematically illustrated in FIGS. 13 and 14. The adapter 201 includes a hooded arrangement 203 with a lower, generally circularly shaped plate 205 configured to be operatively spaced in abutting engagement with a substantially horizontal upper surface portion 207 of the surge conveyor apparatus 249. The adapter 201 also includes a flexible closure member 209 whereby the closure member 209 and the abutting engagement between the adapter 201 cooperatively assist with the provision of a negative relative pressure within the surge conveyor apparatus 249 as hereinafter described.

The adapter 201 is configured whereby an axis of the collecting conveyor apparatus 247, as defined by the direction of travel of the ingredients on the belt conveyor 253, can have various angular orientations relative to an axis of the surge conveyor apparatus 249, similarly defined, as indicated by the arrows designated by the numeral 211 in FIG. 14.

It is to be understood that use of the collecting conveyor apparatus 247 is not restricted to the improved concrete mixing plant 1 taught herein, but, instead, is readily adaptable as a subsystem to many existing portable and fixed-base applications of a similar nature.

Figure 9:
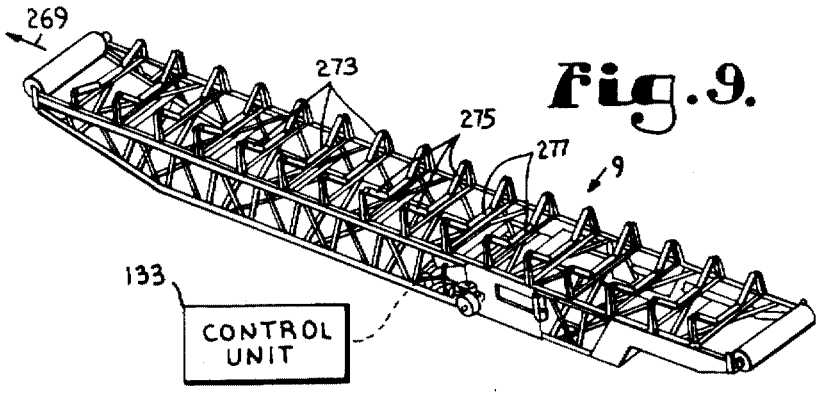
FIG. 9 is an isometric and fragmentary view of a substructure of a surge conveyor apparatus of the portable concrete mixing plant.

The portion of the frame means 3 for the surge conveyor apparatus 249 includes a surge conveyor chassis 263 mounted on one or more wheel and axle assemblies 265. The surge conveyor apparatus 249 has a belt conveyor, shown schematically by the broken lines designated by the numeral 267 in FIG. 10, that is driven such that ingredients deposited thereon by the collecting conveyor apparatus 247 are conveyed to the mixing means 5, as indicated by the arrow designated by the numeral 269 in FIG. 9, and gravitationally unloaded into the input chute 45, as indicated by the arrow designated by the numeral 271 in FIG. 6. As indicated in FIG. 9, the belt conveyor 267 is supported on troughing rollers 273, such that side rollers 275 thereof are angled and elevated relative to middle rollers 277 thereof, in order to cradle and convey the ingredients in a trough-like arrangement. Preferably, the belt conveyor 267 is dimensioned whereby the entire ingredients for the next batch of the concrete material 8 to be mixed in the mixing drum 13 can be temporarily retained thereon. The belt conveyor 267 is appropriately communicatively coupled to the control unit 133 such that starting and stopping of the belt conveyor 267 may be monitored and controlled by the control unit 133.

Preferably, the lengthwise structure of the belt conveyor 267 is relatively rigid, as indicated in FIGS. 9 and 10. In that event, a hydraulic arrangement 279 of the surge conveyor chassis 263 may be extended to appropriately elevate a discharge end 281 thereof whereby ingredients being conveyed by the belt conveyor 267 may be gravitationally deposited into the input chute 45 for further distribution, either to the mixing cavity 49 or to the bypass chute 50 as hereinbefore described.

The containing means 7 also generally includes a silo 287 mounted on a silo chassis 289 of the frame means 3 having one or more wheel and axle assemblies 290. The silo 287 is configured to be operatively self-erecting and superimposed over the belt conveyor 267. The silo 287 generally has at least one partition 291 in order to provide a plurality of compartments, such as a compartment 292 for containing powdered cement in bulk and a compartment 293 for containing "fly ash" in bulk. The silo 287 also includes an underlying hopper 295, as shown in FIG. 10. The hopper 295 includes a load cell arrangement 297 that is communicatively coupled to the control unit 133 for monitoring and controlling purposes. The load cell arrangement 297 is configured to operatively determine and gravimetrically control, in cooperation with the control unit 133, the quantity per batch of the ingredients that are sequentially released into the hopper 295 from the respective overlying compartments 292 and 293.

Due to their fineness and reduced density, ingredients 301 contained in the hopper 295 are prone toward generating contaminating airborne particles upon impact or subjection to air currents. As a result, a chute 299 connected to the surge conveyor apparatus 249 is provided which allows those ingredients 301 to be placed through a butterfly valve 300 from the hopper 295 onto the conveyor belt 267 without subjecting the ingredients 301 to a substantial vertical drop. A bellows 304 provides a relatively air-tight sealing arrangement between the hopper 295 and the chute 299.

Figure 12:
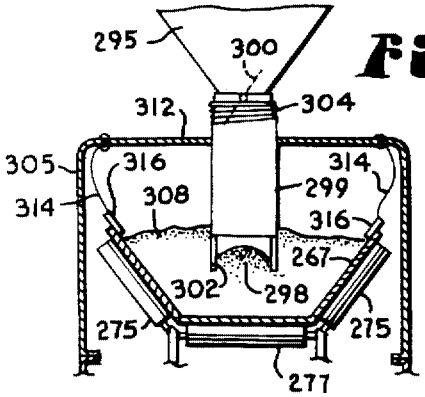
FIG. 12 is an enlarged, fragmentary and partially cross-sectional view of the surge conveyor and a chute ploughing a furrow in ingredients being conveyed by the surge conveyor of the portable concrete mixing plant.
Figure 11:
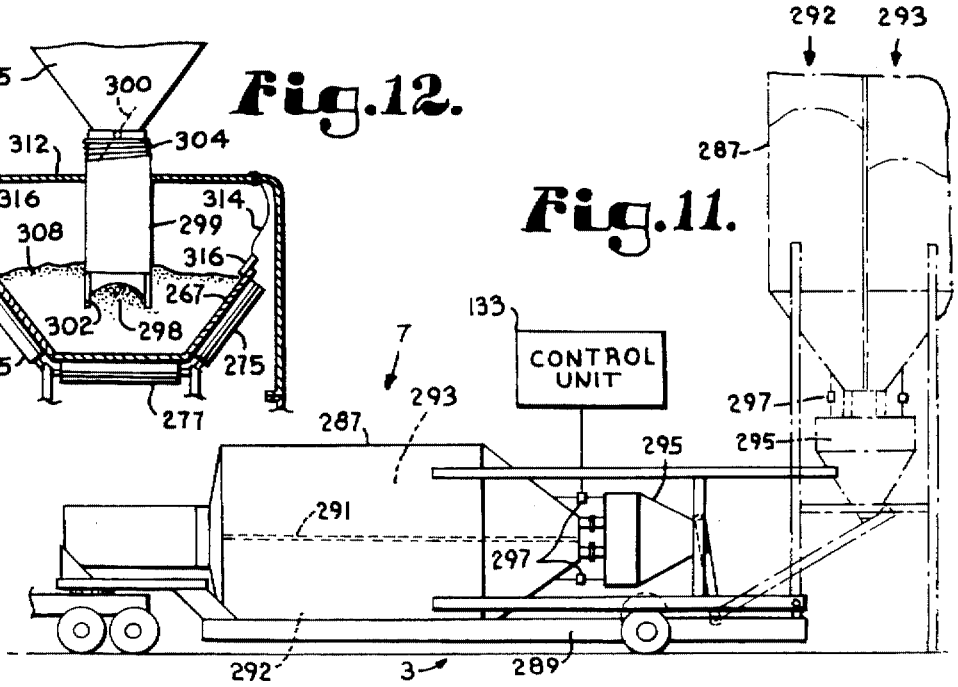
FIG. 11 is a side elevational and fragmentary view of a silo of the portable concrete mixing plant, showing the silo in a transport configuration in solid lines and in an operating configuration in phantom lines.

The chute 299 also serves as a plough to create a furrow 302 in heavier ingredients 303, generally gravel and sand passing from the collecting conveyor apparatus 247 to the mixing means 5 as illustrated in FIG. 12, to receive the lighter ingredients 301 being placed on the conveyor belt 267. Behind the chute 299, the heavier ingredients 303 fold over the lighter ingredients 301 further minimizing any tendency to generate airborne particulate matter from the ingredients 301.

In order to minimize or entirely eliminate any contamination arising from airborne particulate matter, a containment system 310 is provided. The containment system 310 generally includes a cover 312 with flexible partitions 314 having resilient strips 316 that provide a sliding sealing engagement with the belt conveyor 267 wherein the space enclosed within the surge conveyor apparatus 249 is connected by duct 317 to filtering means, such as a baghouse 318. Similarly, the compartments 292 and 293 are connected to the baghouse 318 by a silo duct 320. An adapter 319, similar to the adapter 201 and as illustrated in FIG. 10, provides an abutting engagement with the mixing drum 13 in order to cooperatively assist with the provision of a negative relative pressure within the surge conveyor apparatus 249 as hereinafter described.

Blower means 322 draws air through the ducts 317 and 320 such that a negative pressure, relative to the ambient atmosphere, is generated in the surge conveyor apparatus 249, the mixer drum 13, and the compartments 292 and 293, thereby preventing airborne particulate matter from escaping into the atmosphere. For example, the blower means 322 may provide a negative pressure of approximately one-half inch to one-inch $H_2O$ column within the containment system 310.

The baghouse 318 filters the particulate matter from the air drawn from the containment system 310. The filtered particles being predominantly cement and fly ash particles, are conveyed back to the silo 287, for example to the compartment 293 containing fly ash for reintroduction into the system 1, as indicated by the arrow designated by the numeral 324 in FIG. 1. Preferably, the baghouse 318 is situated near an end of the mixer chassis 29, opposite from the control room 134, as shown in FIG. 1.

It is to be understood that use of the surge conveyor apparatus 249, the silo 287 and/or the containment system 310 is not restricted to the improved concrete mixing plant 1 taught herein, but, instead, is readily adaptable as a subsystem to many existing portable and fixed-base applications of a similar nature.

As an example of an application of the present invention, the four mobile chassis, namely the mixer chassis 29, the collecting conveyor chassis 251, the surge conveyor chassis 263, and the silo chassis 289, are transported to a selected jobsite whereat the concrete material 8 is to be mixed. During such transporting operation, the various chassis having transport configuration are transported in such low-profile configurations. For example, the mixer chassis 29 is transported in the transport configuration 39; the silo chassis 289 is transported with the silo 287 in a reclining or non-erected configuration, as shown in solid lines in FIG. 11, etc.

At the selected jobsite, each of the various chassis are appropriately positioned relative to each other. With the possible exception of the silo chassis 289, each has independent hydraulic jacks 331 for leveling and stabilization purposes. Without the aid of an erecting crane, the hydraulic system 37 is used to convert the mixing means 5 from the transport configuration 39 to the mixing configuration 41.

For example, each of the input end 21 and the discharge end 23 of the mixer frame 27 is connected by a pair of cables 334 and 335 and pulleys 336 to one of pair of hydraulic cylinders 337 of the hydraulic system 37. The pair of hydraulic cylinders 337 are connected by a flow divider (not shown) to assume that the hydraulic cylinders 337 will extend and retract in unison.

Figure 15:
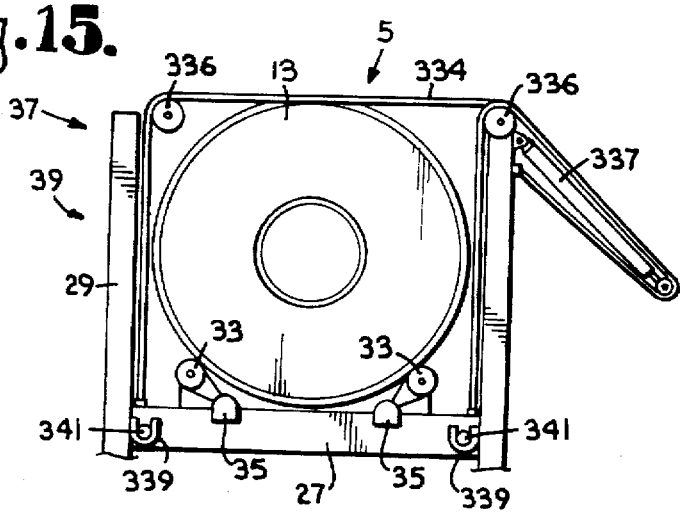
FIG. 15 is an enlarged side elevational and schematic view of the mixing drum of the portable concrete mixing plant, showing an erecting mechanism for the mixing drum in the transport configuration.

As the hydraulic cylinder assumes a retracted position, as schematically illustrated in FIG. 15, the mixing means 5 assumes the transport configuration 39. In that configuration, a yoke 339 situated near each corner of the mixer frame 27 receives a cylindrical peg 341 therein in order to provide structural lengthwise integrity to the mixer chassis 29 as the mixer chassis 29 is being transported. In other words, the arrangement of the four yokes 339 and the four pegs 341 prevents the mixer chassis 29 from sagging and suffering structural damage from stresses caused by pulling the mixer chassis 29 over rough roads and the like.

To self-erect the mixing means 5 from the transport configuration 39 to the mixing configuration 41, the pair of cylinders 337 are extended, as schematically illustrated in FIG. 16. The cables 334 and 335 are pulled over their respective pulleys 336, hoisting the mixer drum 13 to the desired elevated mixing configuration 41. Pins (not shown) may be used in appropriate orifices (not shown) to hold the mixer frame 27 in the mixing configuration 41 to remove stress from the hydraulic system 37.

To transport the mixer chassis 29 to another jobsite, the above erection procedure is reversed, lowering the mixer frame 27 back to the low-profile transport configuration 39 whereat the pegs 341 are nested in the yokes 339.

The discharge chute assembly 71 is hydraulically elevated and rotated to align the collar 85 with the exit port 69 and to place the bracket 81 astraddle of the side member 83. The water source 113 and the air source 123 are appropriately connected to the liquid dispensing means 6.

The surge conveyor chassis 263 is spaced relative to the mixer chassis 29 such that the discharge end 281 of the belt conveyor 267, without the aid of an erecting crane, is positioned such that ingredients to be conveyed thereby are gravitationally directable into the input chute 45, and the silo chassis 289 is appropriately spaced alongside the surge conveyor chassis 263. And, again, without the aid of an erecting crane, the silo 287 is self-erected and superimposed over the belt conveyor 267 as hereinbefore described. The compartments 292 and 293 are appropriately stocked with powdered cement and fly ash. Further, the ducts 317 and 320 are appropriately connected between the cover 312, the silo 287, and the baghouse 309 which, in turn, is connected to the compartment 293 by return conveyor 324.

The collecting conveyor chassis 251 is spaced relative to the surge conveyor chassis 263 whereby one end of the belt conveyor 253 is positioned such that ingredients to be conveyed thereby are gravitationally directable onto the belt conveyor 267. The bins 257 are appropriately stocked with gravel, sand, etc.

In addition to necessary erection procedures, all monitorable and controllable components are appropriately communicatively coupled to the control unit 133.

Upon signal from the control unit 133, the containment system 310 is evacuated and selected amounts of ingredients from the bins 257 are first deposited on the feeder belt conveyors 259 and then deposited on the belt conveyor 253. Upon communication of an appropriate signal from the control unit 133, the ingredients deposited on the belt conveyor 253 are conveyed to and deposited on the belt conveyor 267. If desired, the control unit 133 may also signal the collecting conveyor apparatus 247 to place appropriate quantities of the ingredients from the bins 257 onto the belt conveyor 253 in advance preparation for the following batch of the concrete material 8.

Upon signal from the control unit 133, selected amounts of ingredients from the compartments 292 and 293 are sequentially deposited in the hopper 295. As the ingredients received by the belt conveyor 267 from the belt conveyor 253 pass there below and upon signal from the control unit 133, the ingredients 298 contained in the hopper 295 are deposited in the furrow 306 that the chute 299 ploughs in the underlying ingredients 308. If desired, the control unit 133 may also signal the silo 287 and load cell arrangement 297 to place appropriate quantities of the ingredients from the compartments 292 and 293 in advance preparation for the following batch of the concrete material 8.

After all of the ingredients for the next batch of the concrete material 8 have been deposited onto the belt conveyor 267 from the belt conveyor 253 and the hopper 295, the belt conveyor 267 is stopped by the control unit 133. Upon signal from the control unit 133, the concrete chute mechanism 71 is placed in the non-discharge configuration 97, a sufficient quantity of the water 107 for the next batch of the concrete material 8 is sprayed into the mixing cavity 49 by the liquid dispensing means 6 in a manner that also cleans all of the surfaces 65 of the mixing cavity 49, and the belt conveyor 267 is activated to unload the ingredients deposited thereon into the mixing cavity 49. After those ingredients have been unloaded and upon appropriate signal from the control unit 133, ingredients from the belt conveyor 253 and the hopper 295 are deposited on the belt conveyor 267 in preparation for the following batch of the concrete material 8. It is to be understood that the nature and quantity of ingredients for each successive batch of the concrete material 8 can be the same or different, as determined by the control unit 133.

After an appropriate time interval for appropriately combining the ingredients and the water 107 in the mixing cavity 49 into the desired concrete material 8 and, upon signal from the control unit 133, the discharge chute mechanism 71, without reversing the rotational direction of the mixing drum 13, is displaced from the non-discharge configuration 97 to the discharge configuration 63 whereupon the concrete material is conveyed by the lift flights 57 into the discharge chute 61 to be gravitationally deposited in trucks (not shown) stationed alongside the mixer chassis 29. It is anticipated that the cycle time for most applications for mixing each batch of the concrete material 8 will be approximately ninety seconds.

Upon unloading the last batch in a run of batches of the concrete material 8, the control unit 133 directs water 107 to be sprayed into the mixing cavity 49 to clean any remaining concrete material and ingredients from the interior surfaces 65. After termination of such cleaning procedure, the mixing drum 13 continues to rotate until the water 107 present in the mixing drum 13 from the cleaning procedure is substantially removed by the lift flights 57 and disposed of through the discharge chute 61. It is important to remove such free flowing water 107 from the mixing cavity 49 to avoid over-watering the first batch of the next run of batches of the concrete material 8 processed in the mixing drum 13.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for mixing wet pourable concrete material from a plurality of selected ingredients, comprising:

a) frame means including at least one chassis having at least one wheel and axle assembly;

b) mixing means for mixing the concrete material wherein said mixing means is mounted on said frame means; said mixing means having a low-profile configuration for transporting purposes and an elevated configuration for mixing the concrete material;

c) containing means for containing the plurality of selected ingredients wherein said containing means includes:

1) one or more bins, each containing one of the plurality of selected ingredients, and 2) a silo having one or more compartments, each containing a selected one of the plurality of selected ingredients for mixing the concrete material;

d) control means for controlling transference of selected ones of the plurality of selected ingredients from said containing means; and e) conveying means for receiving the plurality of selected ingredients from said containing means and for conveying the plurality of selected ingredients to said mixing means wherein said conveying means includes:

1) a belt conveyor configured to operably and gravitationally receive the plurality of ingredients from said bins, and 2) a surge conveyor apparatus configured to operatively receive the plurality of ingredients received by said belt conveyor from said bins and to operatively convey those ingredients to said mixing means; and wherein said silo is superimposed over said surge conveyor apparatus and configured to operably and selectively transfer the plurality of selected ingredients contained in said silo to said surge conveyor apparatus.

2. The apparatus according to claim 1, including a feeder belt and corresponding weigh-bridge mechanism interposed between each of said one or more bins and said belt conveyor; each of said feeder belt and corresponding weigh-bridge mechanism configured to operatively transfer a desired quantity of one of the plurality of selected ingredients to said belt conveyor from a respective one of said one or more bins.

3. The apparatus according to claim 2, wherein each of said feeder belt and corresponding weigh bridge mechanism includes means for operatively providing said desired quantity of one of the plurality of selected ingredients to within a tolerance of approximately 1.0%.

4. The apparatus according to claim 1, wherein said surge conveyor apparatus is configured to operatively and temporarily contain quantities of the plurality of selected ingredients from said belt conveyor and said silo sufficient for the next batch of concrete material to be mixed by said mixing means.

5. The apparatus according to claim 1, including a hopper supported by a load cell arrangement for sequentially receiving gravimetrically determined quantities of the plurality of selected ingredients from said silo.

6. The apparatus according to claim 1, wherein said surge conveyor apparatus includes structure such that said surge conveyor is self-erecting.

7. The apparatus according to claim 1, wherein said mixing means includes:

a) a discharge chute assembly; and b) a mixing drum; and c) deploying means for operably deploying said discharge chute assembly relative to said mixing drum.

8. The apparatus according to claim 1, wherein said mixing means includes a mixing drum rotatable about a longitudinal axis thereof wherein said longitudinal axis is substantially horizontally oriented.

9. The apparatus according to claim 8, wherein all interior surfaces of said mixing drum are substantially covered with a concrete-adhering resistant coating.

10. The apparatus according to claim 9, wherein said coating is comprised of urethane having a thickness of approximately one-inch.

11. The apparatus according to claim 1, wherein said mixing means includes a mixing drum and a liquid dispensing system configured to operatively introduce a pre-measured quantity of pressurized water into said mixing drum as an integral part of the process for mixing concrete material in said mixing drum.

12. The apparatus according to claim 11, wherein said liquid dispensing system includes gravimetric means for gravimetrically determining said pre-measured quantity of water.

13. The apparatus according to claim 11, wherein said liquid dispensing system includes volumetric means for volumetrically determining said pre-measured quantity of water.

14. The apparatus according to claim 1, including bypass means configured to operatively and selectively bypass said mixing means such that the plurality of selected ingredients can be deposited into other equipment for further distribution.

15. The system according to claim 1, wherein said conveying means includes blending means for operatively blending the plurality of selected ingredients as the plurality of selected ingredients is received and conveyed to said mixing means by said conveying means.

16. An apparatus for mixing wet pourable concrete material from a plurality of selected ingredients, comprising:

a) frame means including at least one chassis having at least one wheel and axle assembly;

b) mixing means for mixing the concrete material wherein said mixing means is mounted on said frame means; said mixing means having a low-profile configuration for transporting purposes and an elevated configuration for mixing the concrete material;

c) containing means for containing the plurality of selected ingredients wherein said containing means includes:

1) one or more bins, each containing one of the plurality of selected ingredients, and 2) a silo having one or more compartments, each containing a selected one of the plurality of selected ingredients for mixing the concrete material;

d) control means for controlling transference of selected ones of the plurality of selected ingredients from said containing means; and e) conveying means for receiving the plurality of selected ingredients from said containing means and for conveying the plurality of selected ingredients to said mixing means wherein said conveying means includes:

1) a belt conveyor configured to operably and gravitationally receive the plurality of ingredients from said bins, and 2) a surge conveyor apparatus configured to operatively receive the plurality of ingredients received by said belt conveyor from said bins and to operatively convey those ingredients to said mixing means;

f) a baghouse with blower means; and g) containment means, connected to said baghouse, said surge conveyor apparatus, said silo and said mixing means, for providing, cooperatively with said blower means, a negative pressure relative to ambient atmosphere within said surge conveyor apparatus, said silo, and said mixing means such that contamination arising from airborne particulate matter generated within said containment means is substantially eliminated; and wherein said silo is superimposed over said surge conveyor apparatus and configured to operably and selectively transfer the plurality of selected ingredients contained in said silo to said surge conveyor apparatus.

17. An apparatus for mixing wet pourable concrete material from a plurality of selected ingredients, comprising:

a) frame means including at least one chassis having at least one wheel and axle assembly;

b) mixing means for mixing the concrete material wherein said mixing means is mounted on said frame means such that said mixing means is self-erecting from and to a low-profile configuration for transporting purposes and an elevated configuration for mixing the concrete material such that the concrete material, after mixing, can be gravitationally loaded into a concrete truck; said mixing means including a mixing drum rotatable about a longitudinal axis wherein said mixing drum includes:

1) an input end having an input chute, 2) a discharge end having a discharge chute configured to be displaceable axially toward and away from said mixing drum such that concrete material is operatively and selectively dischargeable from said mixing drum, and 3) a mixing cavity having:

A) at least one spiral flight configured to operably urge the plurality of selected ingredients disposed in said mixing cavity from said input end toward said discharge end as said concrete material is being mixed from the plurality of selected ingredients, and B) a plurality of lift flights configured to operably lift the concrete material and gravitationally deposit the concrete material into said discharge chute;

c) containing means for containing the plurality of selected ingredients;

d) control means for controlling transference of selected ones of the plurality of selected ingredients from said containing means; and e) conveying means for receiving the plurality of selected ingredients from said containing means and for conveying the plurality of selected ingredients to said mixing means.

18. The apparatus according to claim 17, wherein said discharge chute includes discharge means for operably discharging concrete from said mixing drum at a selected discharge rate without altering the rate of rotation of said mixing drum about said longitudinal axis.

19. The apparatus according to claim 17, wherein said discharge chute includes discharge means for operably discharging concrete material from said mixing drum without reversing the direction of rotation of said mixing drum about said longitudinal axis.

20. The apparatus according to claim 17, wherein said plurality of lift flights includes deposit means for operatively depositing free flowing liquid within said mixing drum into said discharge chute.

* * * * *